United States Patent [19]

Clemens

[11] Patent Number: 4,527,962

[45] Date of Patent: Jul. 9, 1985

[54] MULTI-CYLINDER FUEL INJECTION PUMP FOR INTERNAL COMBUSTION ENGINES

[75] Inventor: Alexander Clemens, Kornwestheim, Fed. Rep. of Germany

[73] Assignee: Robert Bosch GmbH, Stuttgart, Fed. Rep. of Germany

[21] Appl. No.: 651,982

[22] Filed: Sep. 19, 1984

[30] Foreign Application Priority Data

Nov. 4, 1983 [DE] Fed. Rep. of Germany ..... 3339872

[51] Int. Cl.[3] ..... F02M 59/48

[52] U.S. Cl. ..... 417/499; 417/490; 123/509

[58] Field of Search ..... 417/490, 494, 499; 123/500, 501, 503, 495, 508, 509

[56] References Cited

U.S. PATENT DOCUMENTS 2,482,733 9/1949 Johansson ..... 417/499
3,667,437 6/1972 Dreisin ..... 123/495 X

FOREIGN PATENT DOCUMENTS 218790 5/1961 Austria .
961359 1/1975 Canada ..... 123/501
1184664 7/1959 France ..... 417/494
642736 9/1950 United Kingdom .

*Primary Examiner*—Leonard E. Smith
*Attorney, Agent, or Firm*—Edwin E. Greigg

[57] ABSTRACT

The housing, which is closed at the side, of the fuel injection pump embodied as in-line injection pump has receiving bores, discharging into a camshaft chamber, for in-line tappets and pump elements, the pump pistons of which are rotatable in order to vary the effective supply stroke by means of regulating sleeves provided with guide arms. A governor rod guided in a longitudinal recess of the pump housing engages the guide arms. For the removal and installation of the regulating sleeves, assembly recesses are machined into the receiving bores, beginning at the camshaft chamber and discharging into the longitudinal recess. The assembly recesses, one for each two adjacent receiving bores, are each embodied by means of a single aperture which interrupts the web of housing between the receiving bores. The resultant assembly recesses are located in the unloaded region between the tappets and enable an equally high peak load on the injection pump in both clockwise and counterclockwise operation.

3 Claims, 3 Drawing Figures

Fig. 2
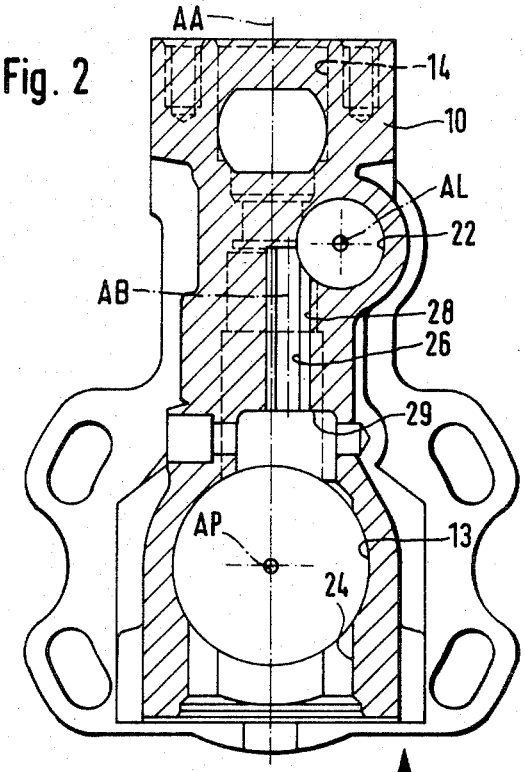
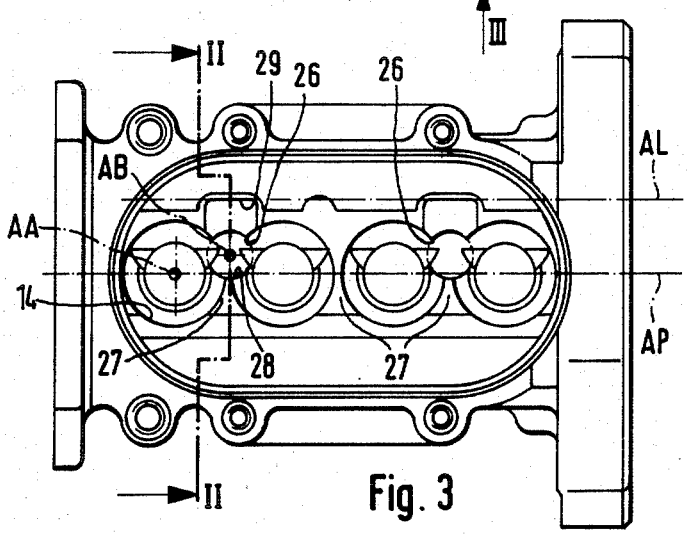
Fig. 3

MULTI-CYLINDER FUEL INJECTION PUMP FOR INTERNAL COMBUSTION ENGINES

BACKGROUND OF THE INVENTION

The invention is based on a fuel injection pump of the general type described hereinafter. Such fuel injection pumps, also known as in-line injection pumps, such as Type PES . . . MW . . . made by Robert Bosch GmbH, have a laterally closed pump housing, which in its side walls has only the required inflow and outflow bores but no openings for use during assembly. The pump elements are inserted from above into the associated receiving bores, while the tappets and tappet springs with their associated spring plate, as well as the regulating sleeves, are inserted into their corresponding receiving bores from below through the opening in the bottom of the pump housing. To enable the installation and removal of the regulating sleeves, each receiving bore has an assembly recess, opening into the longitudinal recess for the governor rod. In these fuel injection pumps, Type PES . . . MW . . . , these assembly openings are each embodied by one assembly groove machined into the wall of each receiving bore, but the assembly groove extends somewhat eccentrically in the surface on which the tappet that drives the pump piston runs. These assembly grooves are cut into the pump housing specifically for the purpose of removing the regulating sleeve. Similar assembly grooves are also known from British Pat. No. 642,736, in which they are intended to enable the removal of the pump pistons which are provided directly with guide arms. Assembly grooves which simultaneously act as guide grooves for sliding blocks serving to secure the tappets against twisting are known from Austrian Pat. No. 218 790 and also from the in-line injection pump, Type PE . . . P . . . , of Robert Bosch GmbH, Stuttgart (see Bosch Technical Manual on Diesel Injection Pumps, Types PE and PF, VDT-U 2/1 De of June, 1981).

In all these fuel injection pumps, the surfaces on which the tappets run are interrupted by assembly or guide grooves, and as a disadvantageous consequence of this interruption of the running surface, the maximum possible load can be imposed on these injection pumps only in one operating direction, for instance clockwise. For counterclockwise operation, lesser loads are prescribed, because as a result of the obliquely exerted cam drive force the tappet is always pressed against the same side of the wall.

OBJECT AND SUMMARY OF THE INVENTION

It is accordingly the object of the invention to embody the assembly recesses such that the removal and installation of the regulating sleeves is possible, while on the other hand a weakening of the highly loaded portions in the running surface of the tappet is avoided.

In the multi-cylinder fuel injection pump of the general type described above and embodied according to the invention, the above object is attained by the characteristics disclosed herein. Because of the aperture which embodies the assembly recesses for two adjacent receiving bores and interrupts the web of housing between these bores, the assembly recesses are laterally so widely offset in the unloaded area of the tappet guide surface that the injection pumps can now be advantageously operated at the maximum load both for clockwise and counterclockwise operation. Since only every second housing web is interrupted, this provision does not, contrary to earlier fears, have a disadvantageous effect on the mechanical stability of the pump housing. Further advantageous embodiments of the invention are also disclosed. The aperture embodied by a bore in accordance with this invention can be fabricated in a simple and economical manner from the underside of the housing.

The invention will be better understood and further objects and advantages thereof will become more apparent from the ensuing detailed description of a preferred embodiment taken in conjunction with the drawings.

BRIEF DESCRIPTION OF THE DRAWINGS

FIG. 2 is a corresponding cross section taken through the associated pump housing along the line II—II in FIG. 3, but without the other pump components shown in FIG. 1 for the sake of better illustration of the assembly recesses each formed by one aperture; and FIG. 3 is a view of the housing from below in the direction of the arrow III in FIG. 2.

DESCRIPTION OF THE PREFERRED EMBODIMENT

Figure 1:
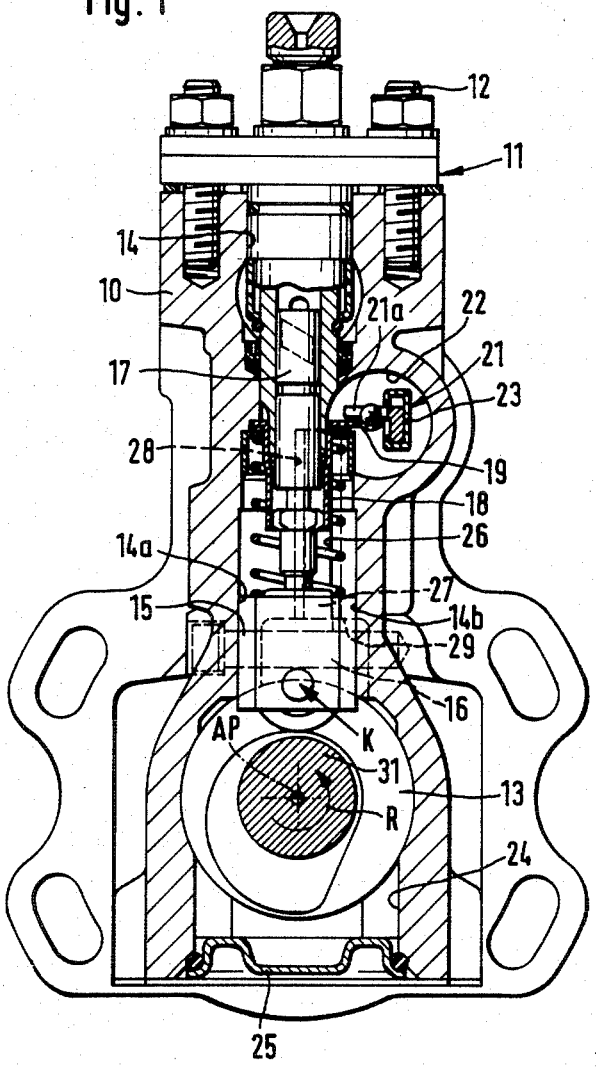
FIG. 1 is a cross section taken through the fuel injection pump according to the invention.

The multi-cylinder fuel injection pump shown in FIG. 1 in a cross section taken through one pump element is a four-cylinder in-line injection pump, into the pump housing 10 of which four pump elements 11, in the present instance embodied as flange elements, are inserted and secured by securing screws 12. The pump housing 10, which is closed at the side, has a tunnellike camshaft chamber 13 extending in the longitudinal axis AP of the pump, and receiving bores 14 for the in-line pump elements 11 and for associated tappets 15 discharge into this camshaft chamber 13 at right angles to the longitudinal axis of the pump. Each of the tappets 15, which are embodied as roller tappets and are secured against twisting by a locking element 16 disposed between each two tappets 15, drives one pump piston 17. In order to vary the effective supply stroke, the pump piston 17 is rotatable by means of a regulating sleeve 18, which is disposed coaxially with respect to it, and by means of a guide arm 19 secured on the regulating sleeve 18. The guide arms 19 of the regulating sleeves 18, which are part of a so-called "guide arm regulation", are engaged by a governor rod 21 provided with associated recesses 21*a;* the governor rod 21 is guided in a guide rail 23 in a manner known per se in a longitudinal recess 22 disposed parallel to the longitudinal axis of the pump. In order to enable the described coupling between the regulating sleeves 18 and the governor rod 21, the longitudinal recess 22 intersects the receiving bores 14. A bottom opening 24 in the pump housing 10, which begins at the camshaft chamber 13 in a projection of the receiving bores 14, is closed in a oil-tight manner by means of a closure cover 25.

In order to enable removal and installation of the regulating sleeves 18 through the bottom opening 24 from the direction of the camshaft chamber 13, assembly recesses 26 are machined into the wall of each receiving bore 14, beginning at the camshaft chamber 13 and discharging into the longitudinal recess 22 (see FIGS. 2 and 3 in particular). In accordance with the invention, the assembly recesses 26 for two adjacent receiving bores at a time are now embodied by a single aperture 28, which interrupts or severs a housing web 27 between these two receiving bores 14 and extends from the camshaft chamber 13 to approximately the level of the middle of the longitudinal recess 22.

Although the aperture 28 may be formed by casting or by reaming, it is preferably produced by means of a bore disposed parallel to the two adjacent receiving bores 14 and spaced apart from each by an equal distance. The bores forming the apertures 28 can be economically drilled into the pump housing 10 like the receiving bores 14; appropriate pockets 29 in the pump housing 10, which are equipped with a flat bottom, facilitate the drilling operation and the introduction of the regulating sleeves.

The longitudinal axis AB of the bore which forms the aperture 28 extends spaced apart by a respective predetermined distance from the longitudinal axes AA of the adjacent receiving bores 14 and from the longitudinal axis AL of the longitudinal recess 22 for the governor rod 21 in a plane which extends parallel to and between two planes parallel to one another; one of these planes includes the longitudinal pump axis AP and the longitudinal axes AA of the receiving bores 14 and the other includes the longitudinal axis AL of the longitudinal recess 22. By means of this somewhat eccentric disposition of the aperture 28 in the housing web 27, the diameter of the bore forming the aperture 28 can be selected such that the width of the resultant assembly recesses 26, which interrupt both the walls of the receiving bores 14 and the wall of the longitudinal recess 22, is at least equal to the width of the guide arm 19 of the regulating sleeve 18.

If the camshaft 31 is rotating counterclockwise as indicated by the arrow R in FIG. 1, then at maximum cam load, an oblique pressing force, exerted approximately in the direction of the arrow K, results at the running surface 14*a* of the tappet 15 in the receiving bore 14. If a camshaft 31 which operates clockwise is installed in the pump, then the direction of the pressing force K changes, and the opposite running surface, shown at 14*b*, of the tappet is loaded. Since because of the assembly recess 26, which according to the invention is located in the unloaded side area, the running surface 14*b* offers practically the same uninterrupted contact area as the running surface 14*a*, equally high loads can be imposed on the injection pump in both counterclockwise and clockwise operation.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A multi-cylinder fuel injection pump for internal combustion engines, comprising a pump housing having a tunnel-like camshaft chamber extending in the longitudinal axis (AP) of the pump and receiving bores for in-line tappets and pump elements arranged to discharge at right angles into the camshaft chamber, rotatable pump pistons arranged to vary the effective supply stroke, by means of regulating sleeves disposed coaxially with the pump pistons and by means of guide arms secured on the regulating sleeves, a governor rod guided parallel to the longitudinal axis of the pump in a longitudinal recess of the pump housing and arranged to engage the guide arms, and the longitudinal recess arranged to intersect the receiving bores, at least one closable bottom opening in the pump housing which begins at the camshaft chamber and extends in a projection of the receiving bores, assembly recesses beginning at the camshaft chamber and machined into the wall of each receiving bore and arranged to discharge into the longitudinal recess, said assembly recesses enabling the removal and installation of the regulating sleeves, and further wherein said assembly recesses, each for two adjacent receiving bores at a time, are embodied by means of a single aperture which interrupts a housing web between said two receiving bores, beginning at the camshaft chamber and extending to approximately the level of the middle of the longitudinal recess.

2. A multi-cylinder fuel injection pump as defined by claim 1, further wherein said single aperture is embodied by a bore disposed parallel to and spaced apart equally from two adjacent receiving bores.

3. A multi-cylinder fuel injection pump as defined by claim 2, further wherein said single aperture has a bore with a longitudinal axis which extends parallel to and between two planes parallel to one another, one of which planes includes the longitudinal axis (AP) of the pump and the longitudinal axes (AA) of the receiving bores and the other of which planes includes the longitudinal axis (AL) of the longitudinal recess.

* * * * *